US010519949B1

(12) United States Patent
Hankins

(10) Patent No.: US 10,519,949 B1
(45) Date of Patent: Dec. 31, 2019

(54) SUPERIMPOSED STANDING VALVE

(71) Applicant: Dale Hankins, Bakersfield, CA (US)

(72) Inventor: Dale Hankins, Bakersfield, CA (US)

( * ) Notice: Subject to any disclaimer, the term of this patent is extended or adjusted under 35 U.S.C. 154(b) by 0 days.

(21) Appl. No.: 16/172,528

(22) Filed: Oct. 26, 2018

(51) Int. Cl.
*F04B 53/10* (2006.01)
*F04B 47/02* (2006.01)
*E21B 43/12* (2006.01)

(52) U.S. Cl.
CPC ..... *F04B 53/1002* (2013.01); *E21B 43/127* (2013.01); *F04B 47/026* (2013.01); *F04B 53/1087* (2013.01); *F04B 2201/06011* (2013.01); *F04B 2205/501* (2013.01)

(58) Field of Classification Search
CPC F04B 47/026; F04B 53/1002; F04B 53/1087; F04B 53/1022; F04B 53/103; F04B 2201/06011; F04B 2205/501; Y10T 137/7859–7866; Y10T 137/7913–7919; Y10T 137/792; E21B 43/126; E21B 43/127
USPC ..... 137/494, 625.3, 625.36, 625.35, 625.33, 137/625.34, 528, 532, 515, 515.3, 515.5, 137/515.7; 417/555.1, 555.2, 507, 559, 417/569
See application file for complete search history.

(56) References Cited

U.S. PATENT DOCUMENTS 1,696,007 A 12/1928 Lewis
2,206,356 A * 7/1940 Hutchings ..... F16K 15/026 137/515.7
2,723,625 A 11/1955 Nichols
3,074,352 A 1/1963 Vincent
4,557,668 A 12/1985 Jones
4,596,515 A 6/1986 Simon
4,955,949 A * 9/1990 Bailey ..... E21B 21/106 137/327
6,537,042 B1 3/2003 Lundbäck
7,108,059 B1 9/2006 Lanier
7,431,572 B2 * 10/2008 Hoffarth ..... E21B 43/129 417/259

(Continued)

FOREIGN PATENT DOCUMENTS

CN 203297087 U 11/2013
CN 204003388 U 12/2014

(Continued)

*Primary Examiner* — Philip E Stimpert
(74) *Attorney, Agent, or Firm* — Matthew C. McCartney; Eastman McCartney Dallmann LLP

(57) ABSTRACT

The present invention is an improved superimposed standing valve and related method of harvesting oil and gas using a conventional rod pump equipped with the improved superimposed standing valve. The present invention includes a valve cylindrical sleeve disposed between a top cylinder and a main standing valve such that the valve cylindrical sleeve can slide along the top cylinder a fixed valve stroke. A plurality of openings are sealed and unsealed by the movement of the valve cylindrical sleeve. The present invention isolates the pump from the head pressure of the oil and gas inside of the tubing thereby enabling the standing valve of the pump to remain open on both the upstroke and the downstroke. As a result, the improved superimposed standing valve increases pump efficiency and reduces the risk of gas locking. Its cylindrical sealing surfaces also prevent solid formation particles from gravitating downward into the pump chamber.

11 Claims, 11 Drawing Sheets

(56) References Cited

U.S. PATENT DOCUMENTS

| | | | | |
|---|---|---|---|---|
| 196,779 | A1 | 8/2009 | Weaver | |
| 7,891,960 | B2 * | 2/2011 | Lea, Jr. | F04B 47/022 417/552 |
| 9,316,222 | B2 | 4/2016 | Strahov et al. | |
| 10,132,312 | B1 * | 11/2018 | Hankins | F04B 53/10 |

FOREIGN PATENT DOCUMENTS

| | | | |
|---|---|---|---|
| CN | 204783587 | U | 11/2015 |
| CN | 205243806 | U | 5/2016 |

* cited by examiner

Prior Art

SUPERIMPOSED STANDING VALVE

BACKGROUND OF THE INVENTION

Conventional rod pumps are placed near the bottom of a casing in an oil well above a perforated section of the casing. The pump draws oil into the perforated section of the casing, through the pump, and into a tubing. The pump also lifts the oil up to the surface through the tubing by way of a lock, such as an API lock.

The simplest rod pump consists of a plunger which reciprocates inside a longer pump cylinder. The pump cylinder is secured to the tubing.

The plunger is sized to create a fluid seal between the outer diameter ("OD") of the plunger and the inner diameter ("ID") of the pump cylinder. The rod pump has two one-way check valves: a standing valve at the bottom of the pump and a traveling valve in the plunger.

A sucker rod string is connected to a pull rod on one end and is also connected at the other end to a surface pumping unit (often called a grasshopper). In turn, the opposite end of the pull rod is passed through a rod guide to the plunger of the pump. The grasshopper moves the sucker rod string (and the connected pull rod and plunger) up and down creating the up and downstroke of the plunger. As the sucker rod string and pull rod are lifted by the surface pumping unit, the plunger moves upward within the pump cylinder.

As the plunger moves upward, it lifts the oil within the tubing upward toward the surface and forms a pump chamber within the pump cylinder between the pump bottom and the plunger. As the plunger moves upward, pressure decreases in the pump chamber allowing formation pressure to exceed pressure in the pump chamber, which in turn, causes the standing valve to open and oil to enter into the pump chamber through the open standing valve.

In an ideal environment, as the plunger moves downward during the downstroke, the pump chamber decreases in volume and causes the pressure in the pump chamber to exceed the head pressure from fluid in the tubing above the pump and allows the traveling valve to open and oil to pass into the pump chamber above the traveling valve. However, no oil enters the pump chamber below the traveling valve during the downstroke as the head pressure ensures that the standing valve remains closed. During the upstroke, as the plunger moves upward, the pump chamber below the traveling valve increases in volume and causes pressure in the pump chamber below the traveling valve to decrease. Once the pump chamber pressure is lower than the head pressure, the head pressure forces the traveling valve closed. With the traveling valve closed, the standing valve will open once the chamber pressure is less than the formation pressure. Thus, even in an ideal environment, through approximately one-half the pump cycle, the standing valve is closed and no oil enters the pump chamber.

Further, often there are problems that can occur downhole that further decrease the operational efficiency of conventional rod pumps. One such problem is gas locking. In a typical oil well, oil with dissolved gas or gas from the surrounding formations enter the conventional rod pump. If the ratio of gas to oil entering the pump becomes too high, gas locking can occur. More specifically, the presence of too much gas in the pump chamber results in a peak pressure within the pump chamber that is insufficient to overcome the hydrostatic pressure, resulting in the traveling valve remaining closed on the downstroke. Similarly, the presence of too much gas also precludes sufficient reduction in chamber pressure during the upstroke to open the standing valve.

Under such a gas locked condition, the pump simply reciprocates without moving any oil, wasting substantial energy and prematurely wearing the component parts of the pump.

Further, due to the high cost of energy, oil pumps are often shut down in frequent intervals in order to save energy costs. During periods when the pump is shut down, sand and silt mixed in the oil collected in the tubing above the pump begins to settle onto and ultimately reenters the pump. The sand and silt that accumulates in the pump during pump shut down periods causes premature wear on the plunger and traveling valve.

Thus, there is a need for a device that easily mounts to a conventional rod pump that increases its efficiency by increasing the time the standing valve remains open during the pump's operation. There is a further need for a device that reduces the risk of gas locking. There is a further need for a device that prohibits sand and silt mixed with oil in the tubing above the pump from settling back into the pump during periods when the pump is shut down.

SUMMARY OF THE INVENTION

The present invention is an improved superimposed standing valve that enables oil and gas to pass into the pump chamber on both the upstroke and the downstroke of a conventional rod pump, thereby increasing the efficiency of the rod pump and reducing the risk of gas locking (a condition where no oil enters the pump chamber during multiple up and downstrokes). The present invention achieves this result through isolation of the head pressure from the pump components on the downstroke. The present invention further prevents sand and silt mixed in the oil stored within the tubing from settling into the pump and thereby extends the life span of the pump.

The improved superimposed standing valve is sized to mate with a conventional rod pump, a conventional API locking system and a conventional polished rod guide. The primary components of the improved superimposed standing valve include a top cylinder connected to a main standing valve with a valve cylindrical sleeve slidably connected on the top cylinder such that it can open and close the main standing valve. The valve cylindrical sleeve is capable of reciprocal movement with respect to the top cylinder over a fixed stroke distance. The improved superimposed standing valve requires the substitution of a conventional pull rod with a polished pull rod.

The top cylinder of the improved superimposed standing valve has a central passage open at both the top cylinder top and top cylinder bottom and sized to slidably receive the polished rod. Similarly, the main standing valve has a central bore that allows for the polished rod to pass from the top cylinder, through the main valve central bore, and ultimately connect to a plunger of a conventional rod pump. The main valve central bore expands to form a central manifold adjacent the main valve bottom such that the manifold diameter is larger than the main valve central bore diameter so as to enable the flow of fluid into the central manifold despite the presence of a polished rod in the main valve central bore.

The polished rod has a smooth surface and is machined or manufactured to have an outer diameter ($1/1{,}000$ to $10/1{,}000$ of an inch) smaller than the diameter of the central passage of the top cylinder. The central passage of the top cylinder is also machined or manufactured to have a honed inner surface to ensure the proper tolerance with respect to the polished rod outer diameter is achieved. The polished rod properly dimensioned with respect to the honed inner surface of the central passage enables the polished rod to reciprocate with respect to the top cylinder while simultaneously maintaining a fluid seal to preclude the passage of oil from the tubing downward through the central passage. As set forth further below, this fluid seal also ensures that the pump remains isolated from the head pressure Ph within the tubing when the improved superimposed standing valve is closed.

The main standing valve component is formed with a recessed area surface accessible from the main valve top and separated from the main valve top by a cylindrical inner slide wall. The main standing valve has a plurality of openings on the recessed area surface that are each connected to the central manifold by a slanted passageway. The plurality of openings are equally spaced from one another and encircle the main valve central bore. The plurality of openings, the slanted passageways, and the central manifold are each in fluid communication with the outlet of the conventional rod pump. The number and placement of the plurality of openings with respect to one another ensures that the flow of oil is evenly applied to the valve cylindrical sleeve during the upstroke of the polished rod which maximizes the efficiency of the movement of the valve cylindrical sleeve.

The only moving component of the improved superimposed standing valve is a valve cylindrical sleeve which has two distinct sliding surfaces. The valve cylindrical sleeve has a top member with a top aperture which is slidably disposed on a reduced top cylinder portion of the top cylinder and forms the first sliding surface. Connected to the bottom of the top member is a cylindrical sliding portion which is slidably disposed within the inner slide wall and forms the second sliding surface. The cylindrical sliding portion has a plurality of sidewall ports that serve as the outlet for oil and gas when the valve cylindrical sleeve is in the open position. The sidewall ports are sealed by the inner slide wall, which serves to block the flow of oil and gas out of the sidewall ports when the valve cylindrical sleeve is in the closed position.

In an alternative embodiment of the improved superimposed standing valve, the sidewall ports are omitted from the sliding portion of the valve cylindrical sleeve and instead main valve sidewall ports are placed through in the inner slide wall of the main valve body, above the recessed area surface. The top member and cylindrical sliding portion have an aperture sidewall extending along a central axis of the top member and cylindrical sliding portion. The aperture sidewall slides along the top cylinder reduced diameter portion. This configuration allows for a larger sliding surface area between the aperture sidewall and the top cylinder reduced diameter portion. The exterior surface of the cylindrical sliding portion slidably fits within the inner slide wall of the main valve body and seals the main valve sidewall ports on the inner slide wall when in a closed position.

In use, the improved superimposed standing valve is connected between a conventional rod guide and a conventional rod pump, which is secured to the surrounding oil well tubing with a conventional API locking system. One end of the polished rod is connected down hole of the oil well, through the rod guide, through the central passage of the top cylinder and through the main valve central bore of the improved superimposed standing valve, and ultimately into a pump cylinder of a conventional rod pump where it is connected to the plunger of the pump. The other end of the polished rod is connected to the end of a sucker rod string, which in turn is connected to a reciprocating mechanical device known in the art, such as a pump jack. As the sucker rod string and polished rod are moved by the mechanical device up and down, the improved superimposed standing valve reciprocates between an open position and a closed position.

When in a closed position during the down stroke, the top member of the valve cylindrical sleeve rests securely on the main valve top and the plurality of sidewall ports are sealed by the inner slide wall of the main standing valve resulting in a seal from the oil and gas in the tubing above the pump and the resulting head pressure (Ph) in the tubing above the improved superimposed standing valve. During the upstroke, oil and gas flow freely from the pump outlet, into the central manifold, through the slanted passageways and out the plurality of openings, thereby forcing the valve cylindrical sleeve to move from the closed position to the open position due to hydraulic force. Once in the open position, the plurality of sidewall ports are exposed from the inner slide wall thereby allowing the flow of oil and gas from the valve through the sidewall ports and into the tubing above the pump and improved superimposed standing valve. The existing pump already has a pump chamber located between the bottom of the plunger (having a traveling valve) and the inlet of the pump (having a standing valve). However, the addition of the improved superimposed standing valve creates a valve chamber between the plunger and the valve cylindrical sleeve.

As the polished rod moves the plunger upward during the upstroke, the volume of the pump chamber increases while the volume of the valve chamber decreases. Therefore, during the upstroke, the pressure of the pump chamber (Pc) decreases while the pressure of the valve chamber (Pv) increases.

On the upstroke, the decreasing pump chamber pressure Pc enables the standing valve to be opened by the greater formation pressure (Pf), thereby forcing oil and gas into the pump chamber. Simultaneously oil and gas that entered the valve chamber on the previous downstroke, is pushed by the plunger into the central manifold. Once the valve pressure Pv exceeds the head pressure Ph, the flowing oil and gas will flow through the central manifold, slanted passageways and out the plurality of openings until the valve cylindrical sleeve is in the open position allowing the free flow of oil and gas from the sidewall ports and into the tubing above the improved superimposed standing valve.

Ordinarily, on the downstroke of a conventional pump, the traveling valve located in the plunger will not open until the chamber pressure Pc exceeds the head pressure Ph in the tubing. Moreover, on the downstroke, the standing valve remains closed. With the inclusion of the improved superimposed standing valve, during the downstroke, the valve cylindrical sleeve closes as soon as head pressure Ph exceeds the valve pressure thereby isolating the pump from the head pressure. More specifically, a fluid seal is created between the honed inner surface of the central passage and the outer polished surface of the polished rod. This fluid seal coupled with the seal provided by the valve cylindrical sleeve on the downstroke ensures that the pump chamber is isolated from head pressure (Ph) in the tubing created by the oil above the improved superimposed standing valve. This resulting isolation allows the pressure in the pump chamber Pc to remain lower than the formation pressure Pf.

As a result, the pump chamber pressure Pc merely must exceed the valve pressure Pv in order for the traveling valve to open. So equipped, the requisite pressure needed to open the traveling valve is much less than the head pressure Ph thereby increasing pump efficiency. Further this requisite pressure is often lower than the surrounding formation pressure thereby enabling the standing valve to remain open, even on the downstroke.

In the event that the presence of too much gas precludes obtaining a valve pressure Pv in excess of head pressure, the valve cylindrical sleeve remains closed allowing the pump to operate more efficiently without having to overcome head pressure on the upstroke thereby quickly enabling sufficient quantities of oil to enter the valve chamber and preclude a gas locking condition.

A primary advantage of a pump equipped with the improved superimposed standing valve invention is a flow of oil into the pump through the standing valve on both the upstroke and the downstroke. This increases pump efficiency and reduces the risk of gas locking. The improved superimposed standing valve's isolation of the traveling valve and standing valve from the head pressure during the downstroke reduces the risk of gas locking because the chamber pressure remains lower than the formation pressure enabling both the standing valve and the traveling valve to remain open during the downstroke. Moreover, the improved superimposed standing valve also reduces the risk of gas locking because in the event too much gas is present in the pump and valve to open the valve cylindrical sleeve, the pump will continue to operate isolated from the head pressure until sufficient quantities of oil are collected in the valve chamber to create a valve pressure sufficient to overcome the head pressure.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF THE INVENTION

Figure 1:
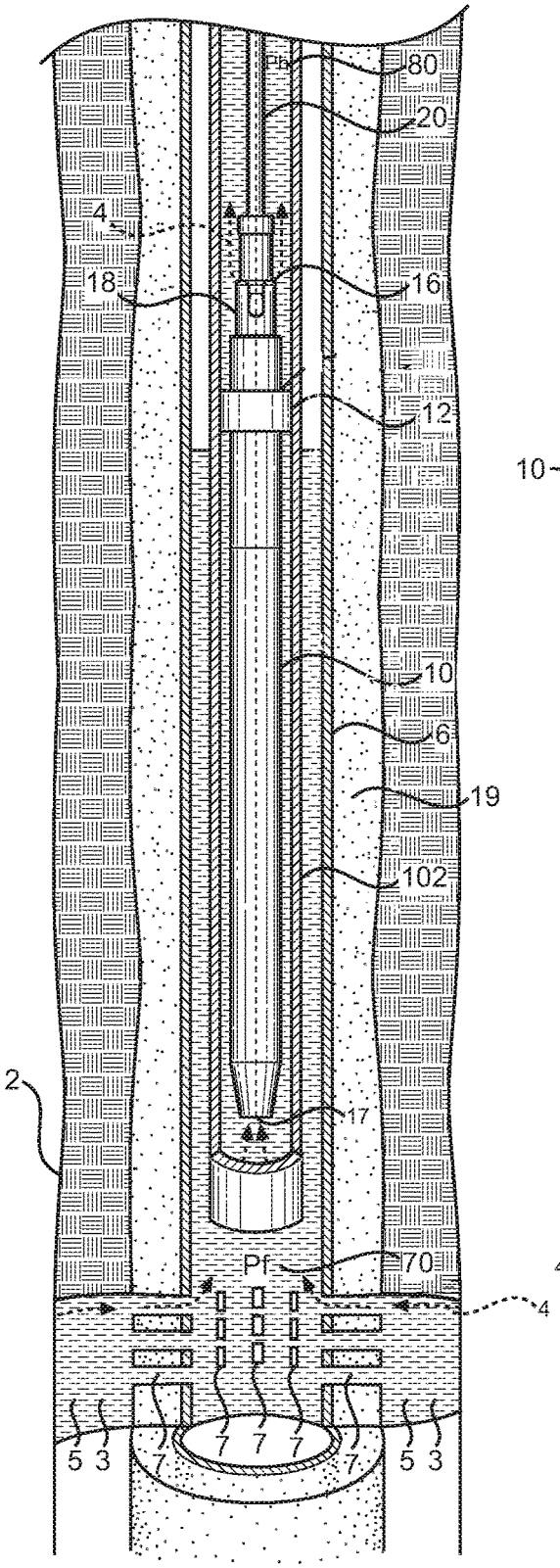
FIG. 1 is a cutaway view of a standard oil well casing and oil well tubing showing a standard prior art oil well pump locked within the tubing and equipped with a standing valve and a traveling valve and an API lock and rod guide.
Figure 2:
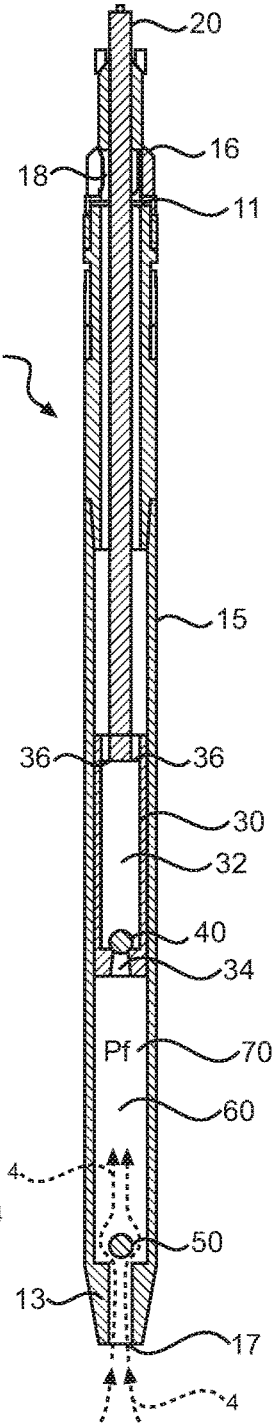
Prior Art FIG. 2
FIG. 2 is a cross sectional view of the standard prior art oil well pump shown in FIG. 1 and showing plunger on upstroke with the standing valve open and the traveling valve closed.
Figure 3:
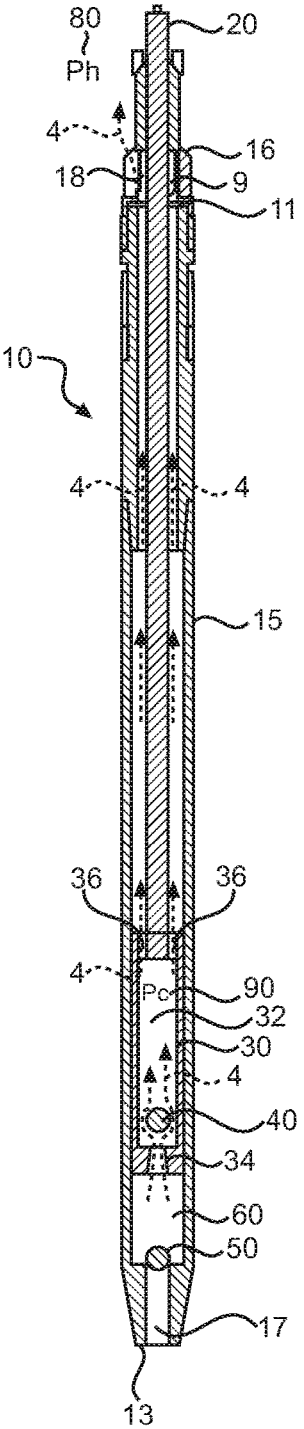
Prior Art FIG. 3
FIG. 3 is a cross sectional view of the standard prior art oil well pump shown in FIG. 1 and showing the plunger on the downstroke with the standing valve closed and the traveling valve open.

Referring first to FIGS. 1-3, a conventional rod pump 10 is generally shown. In FIG. 1, the conventional rod pump 10 is shown within and near the bottom of an oil well tubing 102, which is inside a well casing 6 secured within the ground 2. Oil 3 and gas 5 are drawn into the oil well casing 6 at perforations 7 in the oil well casing 6, below the rod pump 10. The rod pump 10 is secured within and to the tubing 102 using conventional equipment, such as an API lock 12.

One end of a pull rod 20 is inserted through a pump rod guide 16 into the rod pump 10 while the other end of the pull rod 20 is connected to a sucker rod string (not shown). The sucker rod string is connected to mechanical devices on the surface, such as a pump jack, which are omitted from the figures and well known in the art. The pump jack and sucker rod system cause the pull rod 22 to reciprocate in the rod pump 10 and provides the necessary kinetic energy for the rod pump 10 to function.

The rod pump 10 has a pump top 11 and a pump bottom 13 on either end of a pump cylinder 15. The rod pump 10 has a pump inlet 17 at the pump bottom 13 and a pump outlet 18 in a rod guide 16 mounted to the pump top 11. The pump 10 is secured to the rod guide 16 by pump threads 9.

The second end of the pull rod 22 is passed through the rod guide 16, into the pump cylinder 15 and is connected to a plunger 30. The plunger 30 is disposed within the pump cylinder 15 and is connected to the pull rod 20. The plunger 30 is capable of reciprocal movement within the pump cylinder 15. The plunger 30 has a plunger chamber 32 with a plunger inlet 34 and a plunger outlet 36. A traveling valve 40 is connected to the plunger inlet 34 such that traveling valve 40 can open and close at the plunger inlet 34. The plunger 30 slides within the pump cylinder 15 thereby forming a pump chamber 60, the volume of which expands and contracts with the reciprocal movement of the plunger 30.

Formation pressure Pf 70 in the ground surrounding the casing 6 drives oil 3 and gas 5 along flow path 4, through the perforations 7 and into the casing 6. However, oil and gas wells are hundreds to many thousands of feet deep, and therefore head pressure Ph 80 created by the weight of oil 3 within the tubing 102 can be substantial and typically is greater than formation pressure Pf 70. Thus, the pump 10 is required to overcome head pressure Ph 80 to bring oil 3 and gas 5 into the tubing 102 above the rod pump 10, and therefor ultimately to the surface.

At all times, without the benefit of the invention, the pump cylinder 15 above the plunger 30 is subject to the head pressure Ph 80 in the tubing 102 resulting from the weight of the oil 3 and gas 5 above the rod pump 10.

As the plunger 30 is moved towards the bottom 13 of the pump 10, the pump chamber 60 decreases in volume and the chamber pressure Pc 90 increases until the chamber pressure Pc 90 exceeds the head pressure Ph 80 thereby causing the traveling valve 40 to open. Once the traveling valve 40 is open, oil 3 and gas 5 can pass into the plunger chamber 32 through the plunger chamber inlet 34 until the plunger completes its downstroke and begins its upstroke.

On the upstroke, as the plunger 30 is moved towards the top 11 of the pump 10, the pump chamber 60 increases in volume and the chamber pressure Pc 90 decreases. When the chamber pressure Pc 90 is less than the head pressure Ph 80, the traveling valve 40 closes. Once the traveling valve 40 is closed, the expanding volume of the pump chamber 60 causes the chamber pressure Pc 90 to become less than the formation pressure Pf 70. Once the formation pressure Pf 70 is greater than the chamber pressure Pc 90 below it the standing valve 50 opens and oil 3 and gas 5 enter the pump inlet 17 and into the pump chamber 60.

As the pump cycle repeats, oil 3 and gas 5 passed into the plunger chamber 32 pass through the pump chamber outlets 36 and into the pump cylinder 15. The reciprocating plunger 30 lifts oil 3 and gas 5 out of the pump cylinder 15, through pump outlet 18 in the rod guide 16 and into the tubing 102 above the pump 10. So long as the pump 10 continues to deliver oil 3 into the tubing 102, the pump 10 will fill the tubing 102 with oil 3 until it reaches the surface where it can be collected.

However, a primary inefficiency in the pump 10 and process shown in FIGS. 1-3 is that at all times the pump 10 must work to overcome the head pressure Ph 80 in the tubing 102. Moreover, problems can arise if too much gas enters the pump chamber 60.

Figure 4:
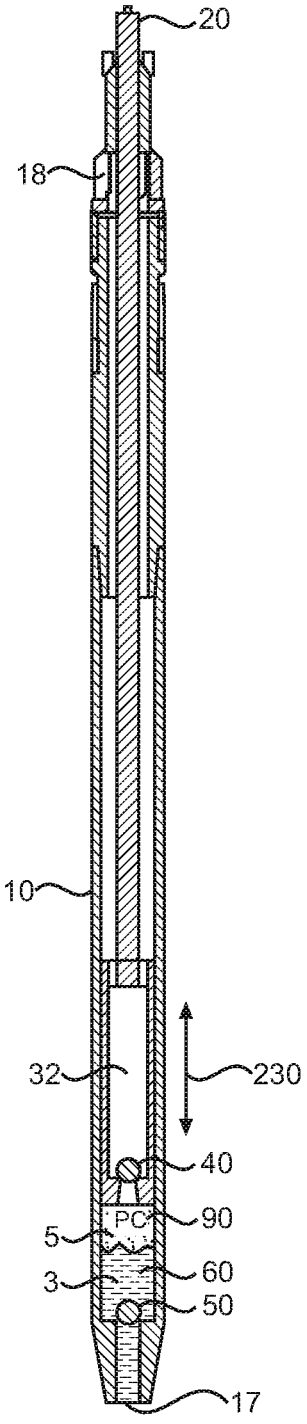
FIG. 4 is a cross sectional view of the standard prior art oil well pump shown in FIG. 1 and showing the pump in a gas locked condition with the standing valve and the traveling valve both closed.

FIG. 4 shows the conventional pump 10 disclosed in FIGS. 1-3 operating when too little oil 3 is located in the pump chamber 60 and as a result, the chamber pressure Pc 90 is insufficient to open the traveling valve 40. As a result, no oil 3 or gas 5 is passed into the plunger chamber 32. Such a condition is known in the art as gas locking. Moreover, the head pressure Ph 80 acting against the chamber pressure Pc 90 reduces the allowable amount of gas 5 that can be present in the pump chamber 60 before gas locking occurs.

The present invention seeks to improve the operational efficiency of the rod pump 10 and reduce the risk of gas locking through isolation of the pump 10 from head pressure Ph 80 during the downstroke thereby increasing the probability that the traveling valve 40 will open on the downstroke and the standing valve 50 will remain open on the reciprocating motion 230.

Figure 5A:
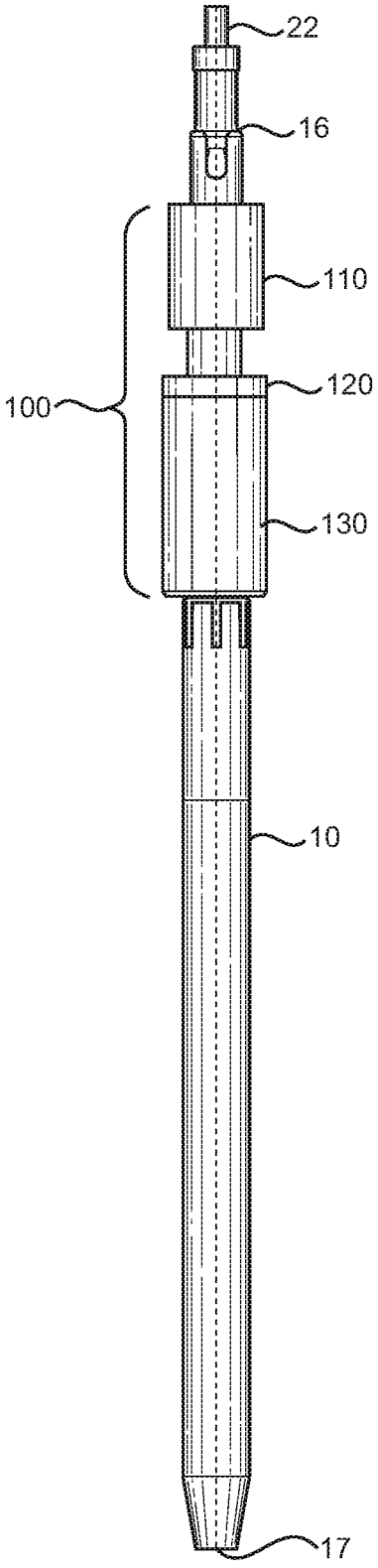
Prior Art FIG. 5A
FIG. 5A is a side view of a standard oil well pump equipped with an improved superimposed standing valve on the downstroke with the valve cylindrical sleeve closed.
Figure 5B:
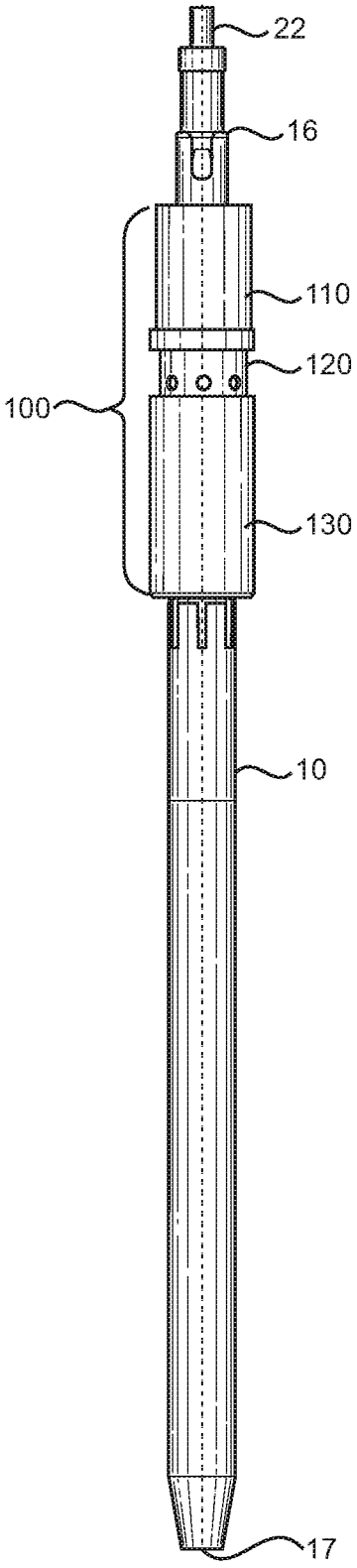
FIG. 5B is a side view of a standard oil well pump equipped with an improved superimposed standing valve on the upstroke with the valve cylindrical sleeve open.
Figure 6A:
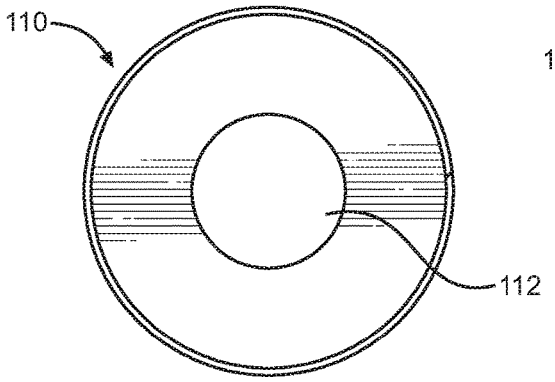
FIG. 6A is a top view of the top view of the improved superimposed standing valve and showing the honed central passage in the top cylinder.
Figure 6C:
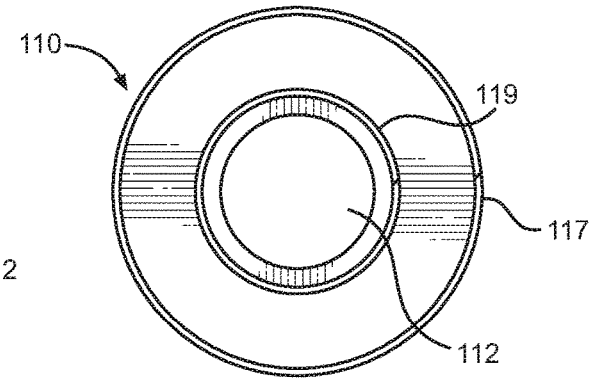
FIG. 6C is a bottom view of the top cylinder of the improved superimposed standing valve and showing a stopping surface formed by the larger diameter sidewall of the top cylinder.
Figure 6B:
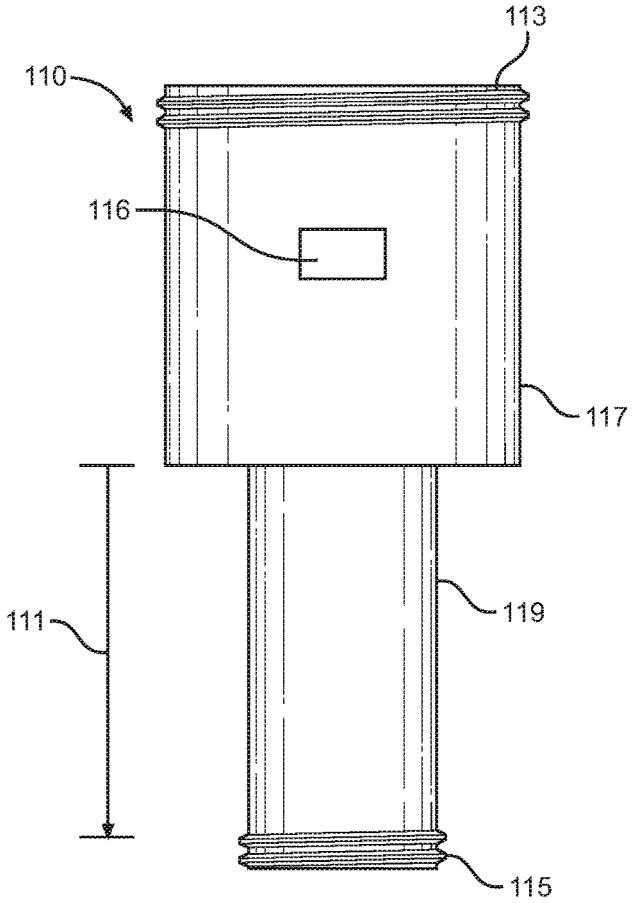
FIG. 6B is a side view of the top cylinder of the improved superimposed standing valve and showing a top cylinder reduced diameter section along a valve stroke length, the top cylinder reduced diameter section sized to slidably receive the sidewall of the top aperture in the top member of the of the valve cylindrical sleeve.
Figure 6D:
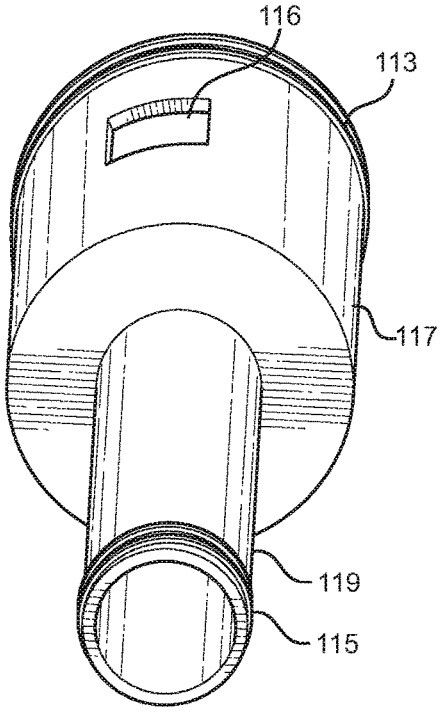
FIG. 6D is a bottom isometric view of the top cylinder showing threads at the bottom portion of the reduced diameter section for connection to mating threads in the main valve.

Turning to FIGS. 5A and 5B, an improved superimposed standing valve 100 is shown disposed between a conventional rod pump 10 and a rod guide 16, which are each omitted from view. An API top lock, also omitted from view, may be installed between the rod guide and the conventional pump. The improved superimposed standing valve 100 has a valve cylindrical sleeve 120 that reciprocates along a top cylinder 110 to open and close a main standing valve 130. FIG. 5A shows the improved superimposed standing valve 100 during the downstroke of the polished rod 22 and pump 10 with the valve cylindrical sleeve 120 in the closed position. FIG. 5B shows the improved superimposed standing valve 100 during the upstroke of a polished rod 22 connected to the rod pump 10 with the valve cylindrical sleeve 120 in the open position.

Turning to FIGS. 6A through 6D, the top cylinder 110 of the improved superimposed standing valve 100 is generally shown with a central passage 112 sized to slidably receive a polished rod 22 (omitted from view). Top cylinder upper threads 113 are provided adjacent the top of the top cylinder 110 and sized to securely mount to a rod guide 16 or API lock (below a rod guide). Top cylinder lower threads 115 are provided adjacent the bottom of the top cylinder 110 and sized to securely mount to the main standing valve 130 (shown in FIGS. 8A through 8D). The top cylinder 110 has a top cylinder diameter portion 117 and a top cylinder reduced diameter portion 119. The top cylinder reduced diameter portion 119 is sized to receive the top aperture sidewall 121 of the valve cylindrical sleeve 120 (shown in FIGS. 7A through 7D). The top cylinder reduced diameter 119 portion has a valve stroke length 111. A wrench indent 116 is provided on the top cylinder diameter portion 117 to allow for an increased gripping surface for a tool such as a wrench when connecting or disconnecting the improved superimposed standing valve 100 to and from the rod pump 10.

Turning to FIGS. 7A through 7D, the valve cylindrical sleeve 120 of the improved superimposed standing valve 110 is generally shown with a top member 122 connected to a cylindrical sliding portion 126 with an open bottom.

A top aperture 124 is formed in the top member 122 and has a top aperture sidewall 121. The top aperture 124 has a top aperture diameter which is slightly larger than the diameter of the top cylinder reduced diameter portion 119 of the top cylinder 110 so as to allow the top aperture sidewall 121 to slide on the exterior surface of the top cylinder reduced diameter portion 119 of the top cylinder 110 along the valve stroke length 111 (Shown in FIG. 6B). The top aperture sidewall 121 may be further equipped with a seal 127, such as an O-ring.

The cylindrical sliding portion 126 has a sliding portion thickness 125 sized to ensure structural rigidity and long life when exposed to oil, gas and other particulates when in use. The cylindrical sliding portion 126 also has a plurality of sidewall ports 128 near the bottom and opposite the top member 122. The sidewall ports 128 are passed through the sliding portion thickness 125 and serve as the outlet for oil and gas exiting the improved superimposed standing valve 100. A seal 127, such as an O-ring may also be fitted around the exterior surface of the cylindrical sliding portion 126 between the open bottom and the plurality of sidewall ports 128. The cylindrical sliding portion 126 has a valve cylindrical sleeve outer diameter which is slightly smaller than the diameter of the inner surface of the inner slide wall 136 (shown in FIGS. 8A through 8D) so as to facilitate a sliding movement between the outer surface of the valve cylindrical sleeve 120 and the inner surface of the inner slide wall 136.

Figure 7A:
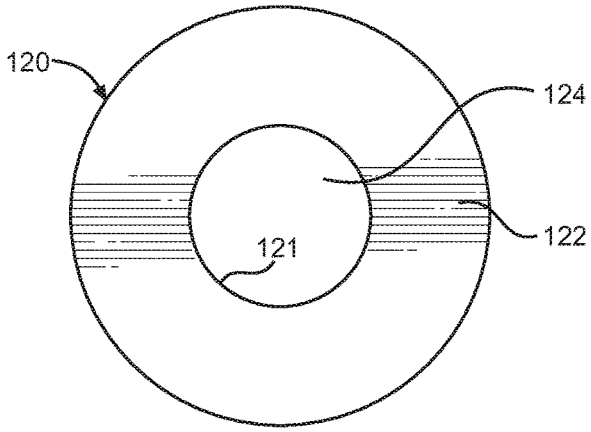
FIG. 7A is a top view of the valve cylindrical sleeve showing the top member formed with a top aperture.
Figure 7B:
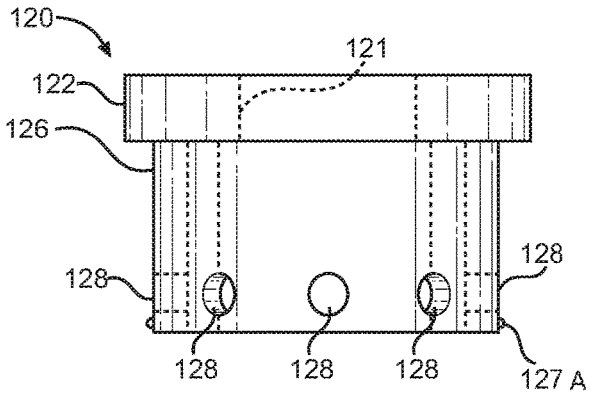
FIG. 7B is a side view of the valve cylindrical sleeve showing a cylindrical sliding portion having a smaller outer diameter than that of the outer diameter of the top member.
Figure 7C:
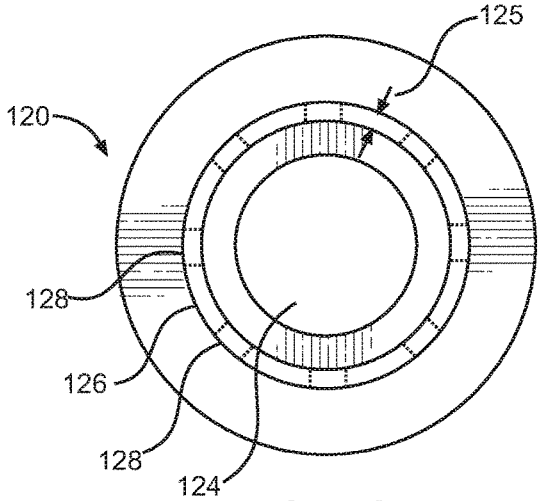
FIG. 7C is a bottom view of the valve cylindrical sleeve showing that the inner diameter of the sliding portion is larger than the diameter of the top aperture.
Figure 7D:
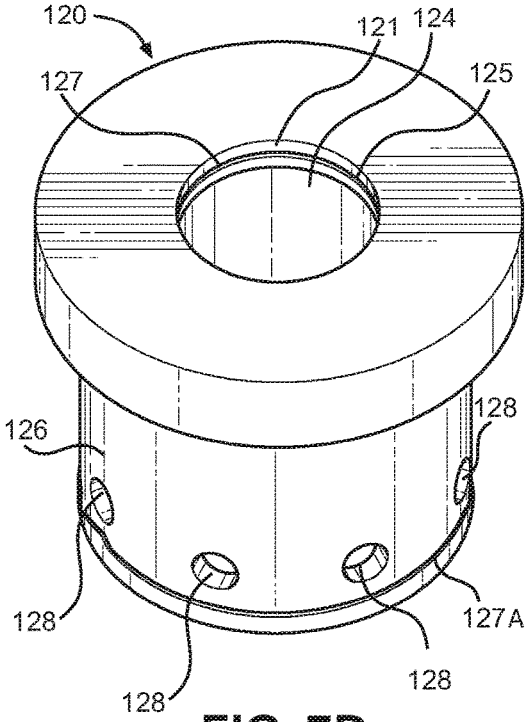
FIG. 7D is a top isometric view of the valve cylindrical sleeve showing a plurality of sidewall ports in the sliding portion adjacent the bottom of the valve cylindrical sleeve.
Figure 7E:
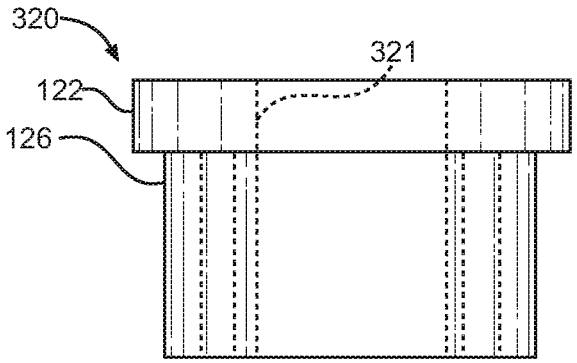
FIG. 7E is a side view of an alternative embodiment of the valve cylindrical sleeve shown in FIGS. 7A through 7D, and shows a top member connected to a cylindrical sliding portion with an aperture sidewall through the central axis of the top member and the cylindrical sliding portion.
Figure 7F:
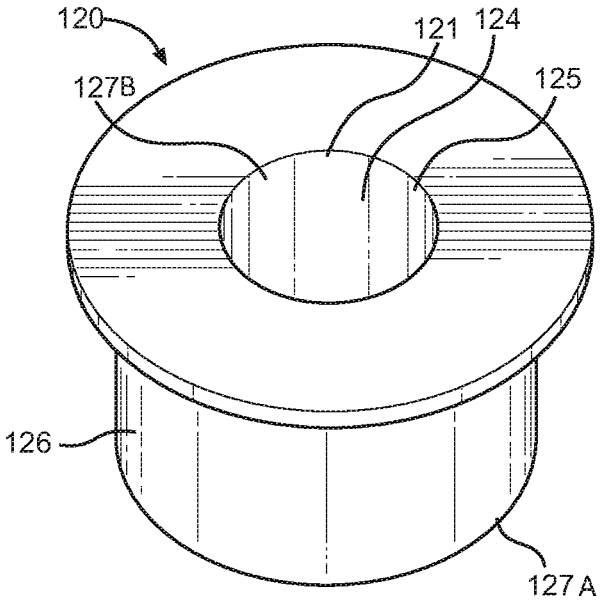
FIG. 7F is a top isometric view of the valve cylindrical sleeve shown in FIG. 7E.

Turning to FIGS. 7E through 7F, an alternative embodiment of the the valve cylindrical sleeve 320 of an improved superimposed standing valve 300 is generally shown with a top member 122 connected to a cylindrical sliding portion 126 with an open bottom.

A top aperture 124 is formed in the top member 122 and has an aperture sidewall 321 that extends from the top of the top member 122 through the bottom of the cylindrical sliding portion 126. The aperture sidewall 321 has an aperture diameter which is slightly larger than the diameter of the top cylinder diameter portion 117 of the top cylinder 110 so as to allow the top aperture sidewall 321 to slide on the exterior surface of the top cylinder reduced diameter portion 119 of the top cylinder 110 along the valve stroke length 111. Unlike the previous embodiment, there are no ports or holes through the cylindrical sliding portion 326 and therefore no outlet for oil and gas exiting the valve 300, which outlet instead is placed in the main valve 330 as set forth below. The balance of the configuration of the valve cylindrical sleeve 320 is identical to the valve cylindrical sleeve 130. The configuration of the aperture sidewall 321 allows for a greater fluid seal between the aperture sidewall 321 and the top cylinder reduced diameter portion 119.

Turning to FIGS. 8A through 8D, the main standing valve 130 of the improved superimposed standing valve 100 is generally shown with a main valve central bore 142 allowing for the passage of the polished rod 22 through the main standing valve 130. The main standing valve 130 has a main valve top 138 and a main valve bottom 139. The main standing valve 130 is formed with a recessed area surface 133 accessible from the main valve top 138 and separated from the main valve top 138 by a cylindrical inner slide wall 136

The recessed area surface 133 has a top cylinder receiver 140 with main valve top threads 131 and a top cylinder receiver seat 141. The top cylinder receiver 140 is sized to securely receive the top cylinder lower threads 115 of the top cylinder 110 and secure the top cylinder 110 against the top cylinder receiver seat 141 and is aligned with the main valve central bore 142.

Similarly, the main valve bottom 139 has a pump receiver 146 with main valve bottom threads 148 and a pump receiver seat 147. The pump receiver 146 is sized to securely receive the pump threads 9 of the pump 10 and secure the pump 10 against the pump receiver seat 147. Disposed between top cylinder receiver 140 and pump receiver 146 is a central manifold 144.

A plurality of openings 132 are located on the main valve top 138 and encircle the top cylinder receiver 140. Each opening 132 is connected to and in fluid communication with the central manifold 144 by way of a slanted passageway 134. The main standing valve 130 has a main standing valve diameter 135 that is approximately equal to the valve cylindrical sleeve outer diameter 124 of the valve cylindrical sleeve 120.

Figure 8A:
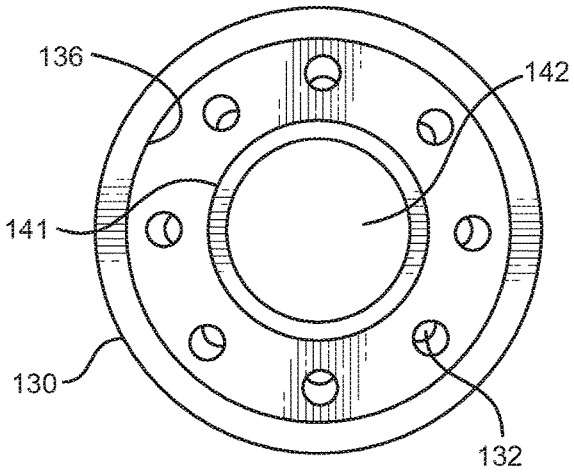
FIG. 8A is a top view of the main valve showing a central bore within a recessed area having a plurality of openings encircling a threaded seat sized to receive the bottom of the top cylinder.
Figure 8C:
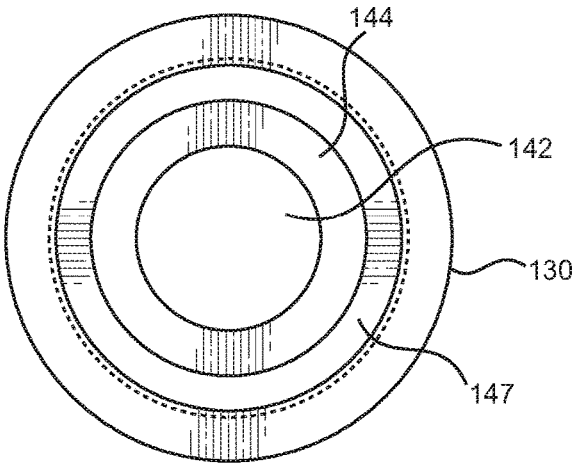
FIG. 8C is a bottom view of the main valve showing the central bore and a bottom threaded seat for connection with the top surface of a conventional oil well pump.
Figure 8B:
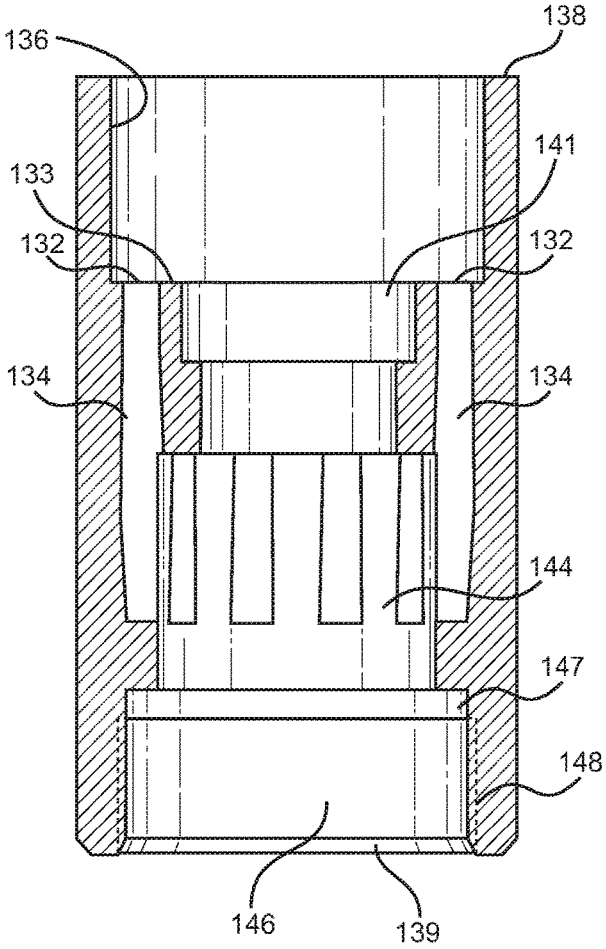
FIG. 8B is a cross-sectional side view of the main valve along the lines 8B-8B shown in FIG. 8D and showing the plurality of openings connected to the central manifold by way of slanted passageways.
Figure 8D:
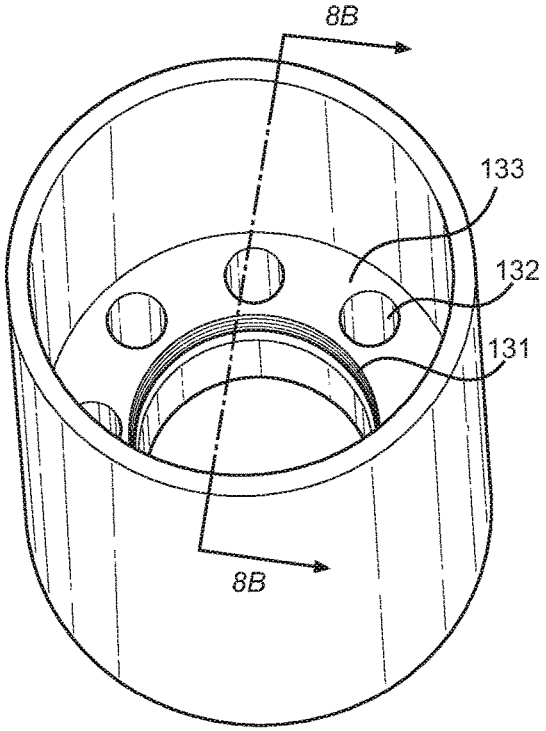
FIG. 8D is a top isometric view of the main valve showing the main valve inner slide wall sized to allow the sliding movement of the sliding portion of the valve cylindrical sleeve.
Figure 8E:
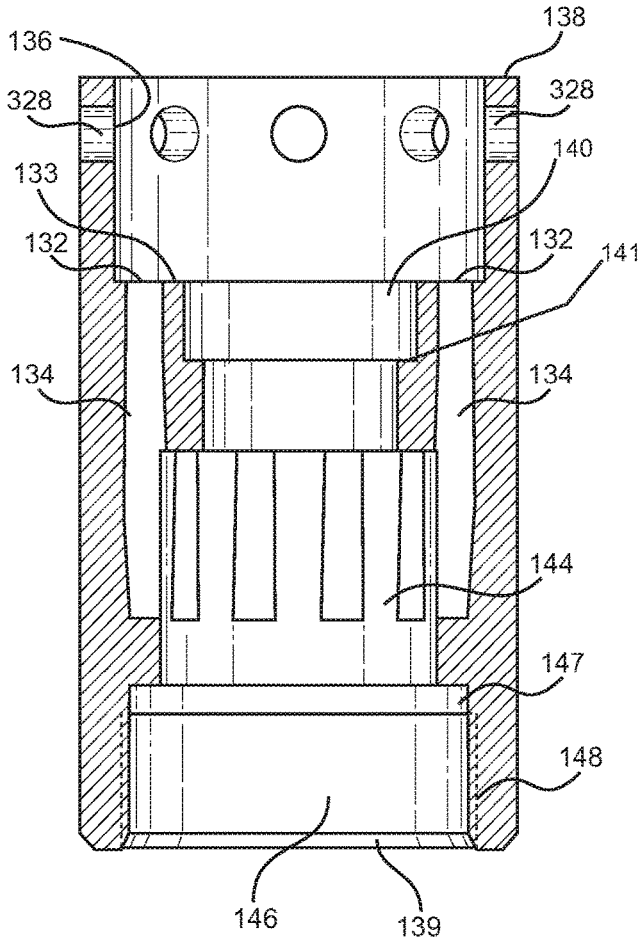
FIG. 8E is a cross-section side view of an alternative embodiment of the main valve along the lines 8E-8E shown in FIG. 8F, and showing main valve sidewall ports fitted into the cylindrical inner slide wall.
Figure 8F:
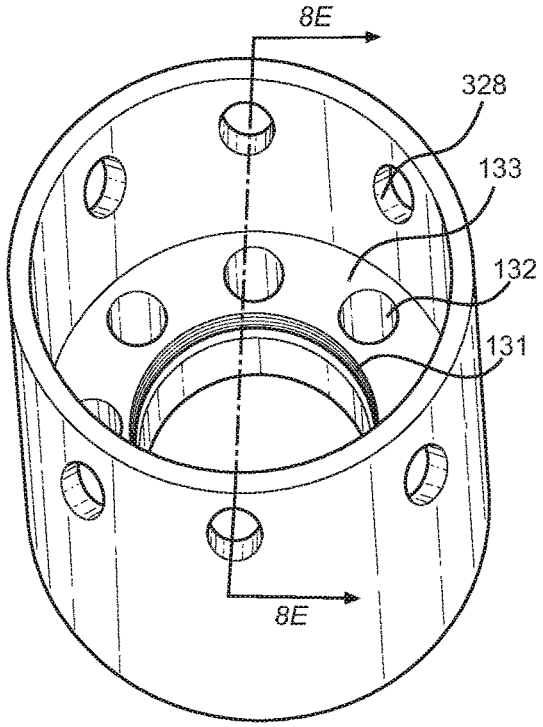
FIG. 8F is a top isometric view of the main valve shown in FIG. 8E and showing the main valve sidewall ports equally spaced from one another and through the cylindrical inner slide wall of the main valve.

Turning to FIGS. 8E through 8F, an alternative embodiment of the main standing valve 330 of the improved superimposed standing valve 300 is generally shown with a plurality of main valve sidewall ports 328 fitted in the cylindrical inner slide wall 136. The plurality of main valve sidewall ports 328 serve as the outlet for oil and gas exiting the alternative improved superimposed standing valve 300. Main standing valve 330 is designed for use with the alternative valve cylindrical sleeve 320 described in connection with FIGS. 7E through 7F. The balance of the configuration of the main standing valve 330 is identical to the main standing valve 130.

Figure 9A:
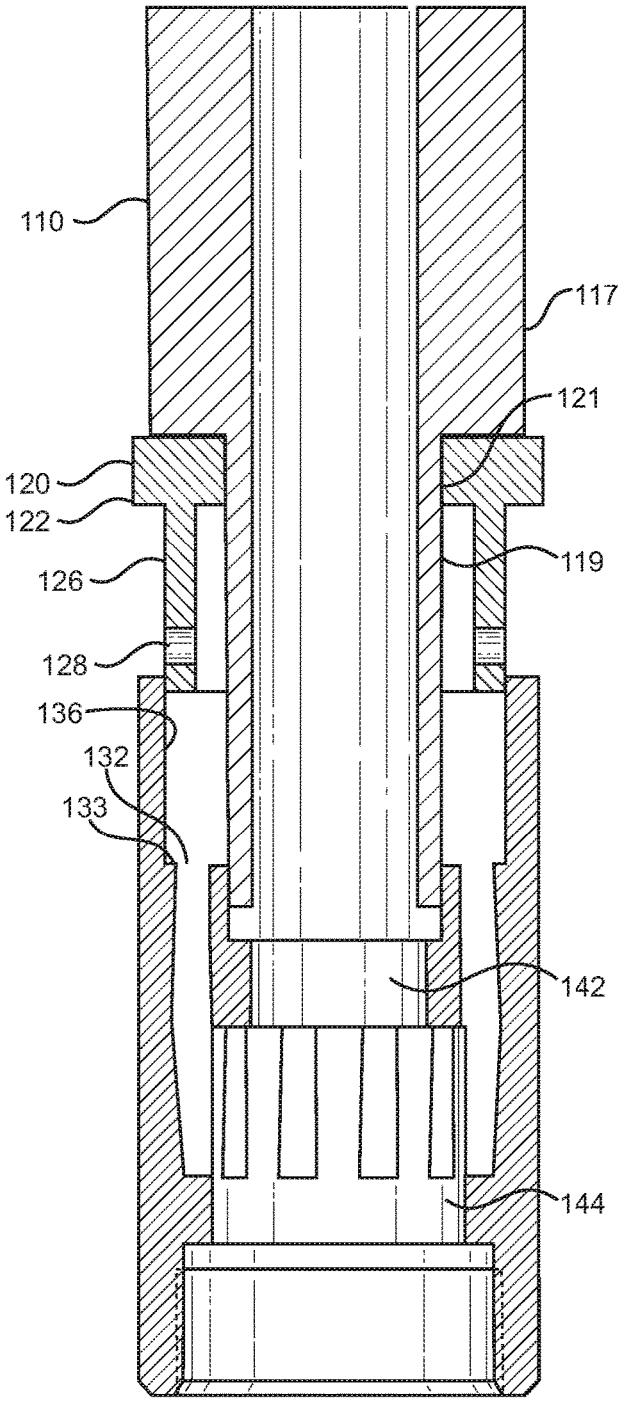
FIG. 9A is a cross-sectional view of the assembled improved superimposed standing valve with the valve cylindrical sleeve in the open position.
Figure 9B:
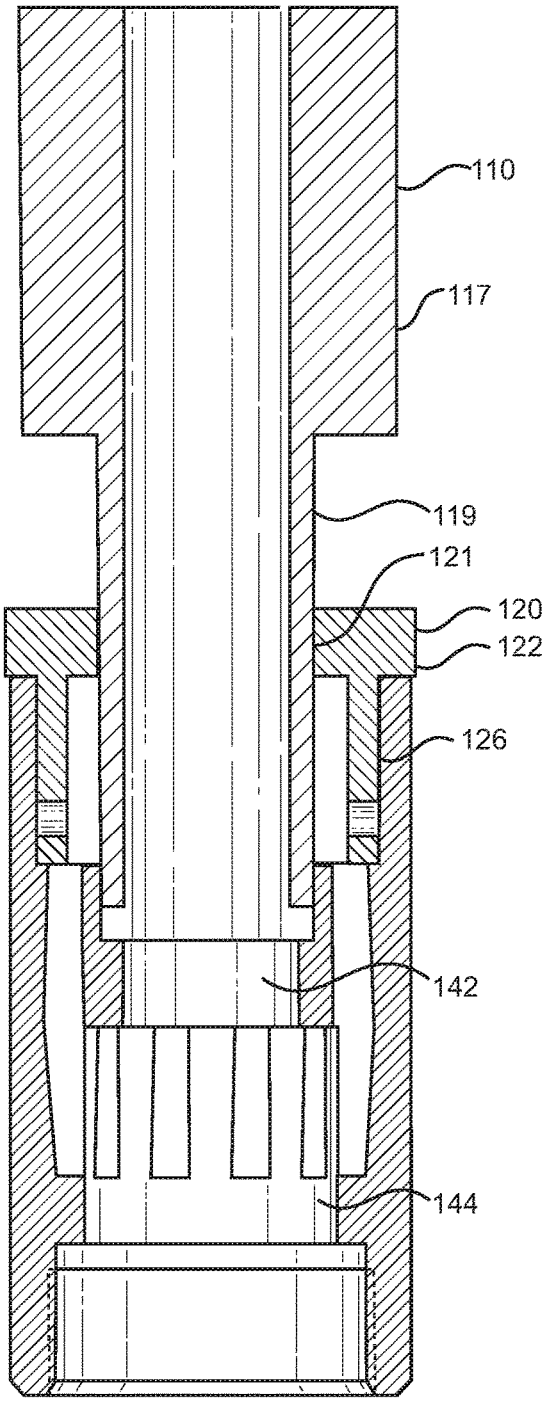
FIG. 9B is a cross-sectional view of the assembled improved superimposed standing valve with the valve cylindrical sleeve in the closed position.

Turning to FIGS. 9A and 9B, cross-sectional views of the assembled improved superimposed standing valve 100 are generally shown with the polished rod 22 omitted from the Figures.

In FIG. 9B, improved superimposed standing valve 100 is shown in a closed position with the valve cylindrical sleeve 120 in a down position in contact with the main valve top 138 of the main standing valve 130 such that the inner slide wall 136 of the main standing valve 130 seals the plurality of sidewall ports 128 and the top member 122 seals the main standing valve 130 at the main valve top 138 so as to preclude the flow of any oil or gas through the improved superimposed standing valve 100.

In FIG. 9A, the improved superimposed standing valve 100 is shown in an open position with the valve cylindrical sleeve 120 in an up position slid away from the main valve top 138 along the valve stroke 111 of the top cylinder 110. The improved superimposed standing valve 100 provides for two sliding points of contact. The first sliding point of contact is between the exterior surface of the top cylinder reduced diameter portion 119 and the top aperture sidewall 121 of the top member 122. The second sliding point of contact is between the exterior surface of sliding portion 126 of the valve cylindrical sleeve 120 and the inner slide wall 136 of the main standing valve 130. The two sliding points of contact increase the lifespan of the improved superimposed standing valve 100 and further improve the stability of the movement of the valve cylindrical sleeve 120 to ensure a proper seal when in the closed position.

Figure 9C:
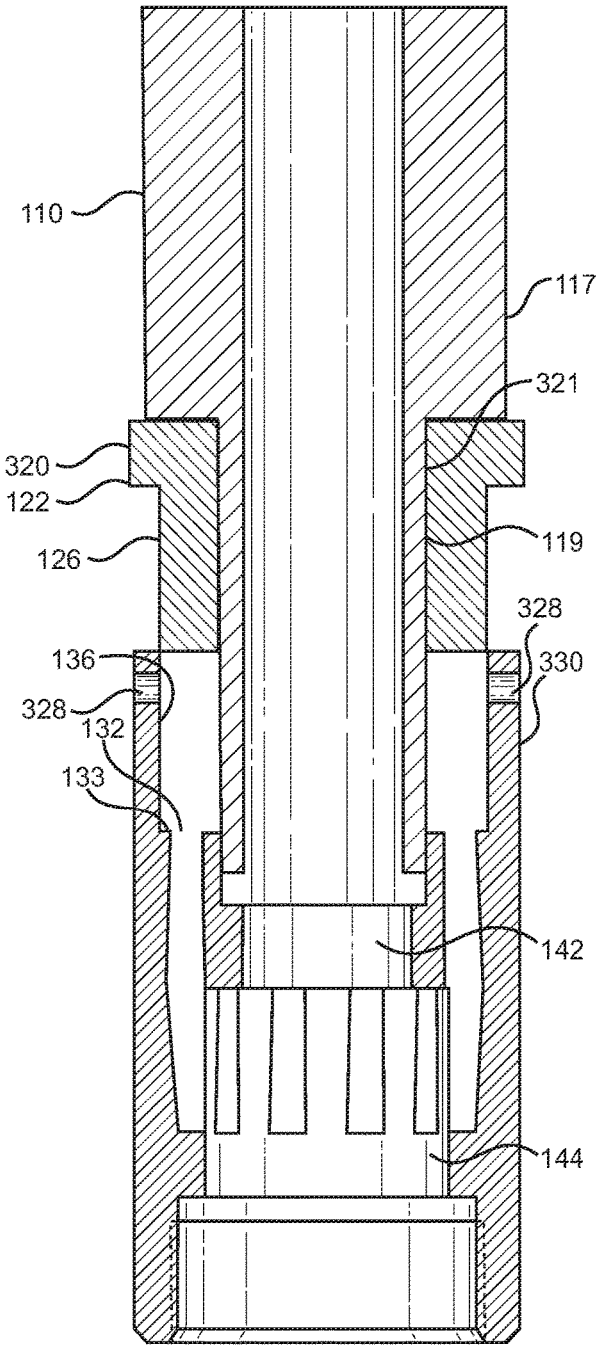
FIG. 9C is a cross-sectional view of the alternative embodiment assembled improved superimposed standing valve with the valve cylindrical sleeve in the open position.
Figure 9D:
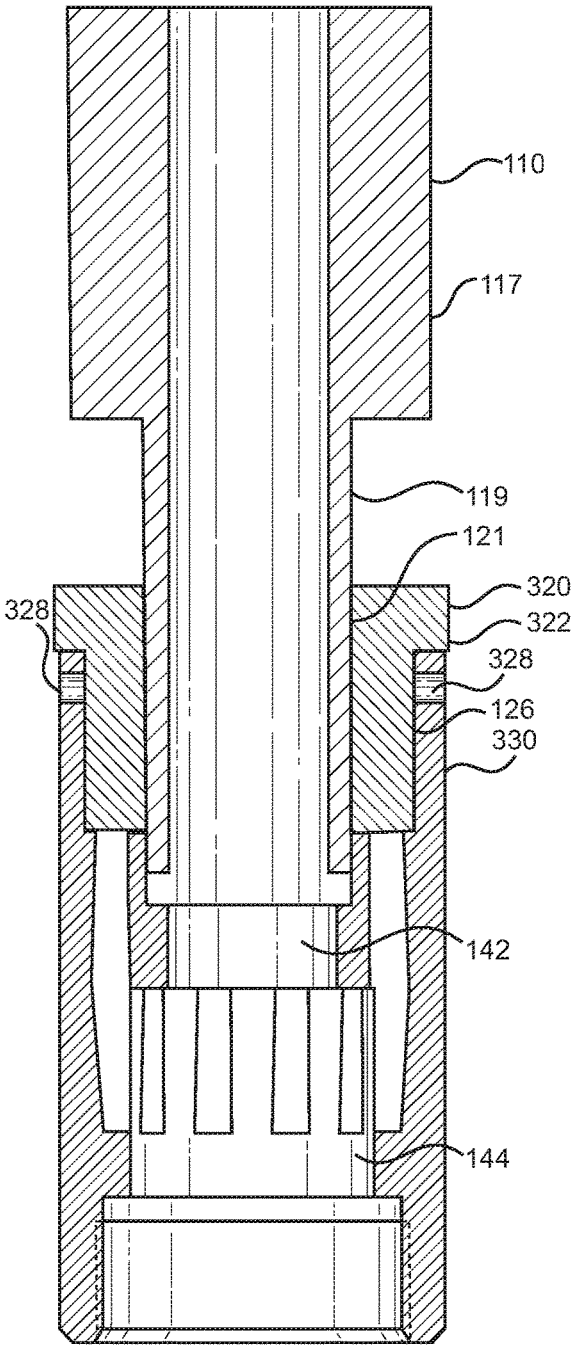
FIG. 9D is a cross-sectional view of the alternative embodiment assembled improved superimposed standing valve with the valve cylindrical sleeve in the closed position.

Turning to FIGS. 9C and 9D, cross-sectional views of the assembled alternative embodiment of the improved superimposed standing valve 300 are generally shown with the polished rod 22 omitted from the Figures.

In FIG. 9C, the improved superimposed standing valve 300 is shown in an open position with the valve cylindrical sleeve 120 in an up position slid away from the main valve top 138 along the valve stroke 111 of the top cylinder 110. The improved superimposed standing valve 100 provides for two sliding points of contact. The first sliding point of contact is between the exterior surface of the top cylinder reduced diameter portion 119 and the aperture sidewall 321 of the top member 122. The second sliding point of contact is between the exterior surface of sliding portion 126 of the valve cylindrical sleeve 120 and the inner slide wall 136 of the main standing valve 130. The two sliding points of contact increase the lifespan of the improved superimposed standing valve 100 and further improve the stability of the movement of the valve cylindrical sleeve 120 to ensure a proper seal when in the closed position. In the open position, the main valve central manifold 144 is in fluid communication with slanted passageways 134, the plurality of openings 132 and with the plurality of main valve sidewall ports 328 so as to enable oil and gas to flow from central manifold 144, through the central passage ways 134, out the plurality of openings 132 and out of the valve 300 through the plurality of main valve sidewall ports 328.

In FIG. 9D, improved superimposed standing valve 300 is shown in a closed position with the valve cylindrical sleeve 320 in a down position 240 in contact with the main valve top 138 of the main standing valve 130 such that the sliding portion 126 of the valve cylindrical sleeve 320 seals the plurality of main valve sidewall ports 328 along the inner slide wall 136 of the main standing valve 330 so as to preclude the flow of any oil or gas through the improved superimposed standing valve 100.

Figure 10A:
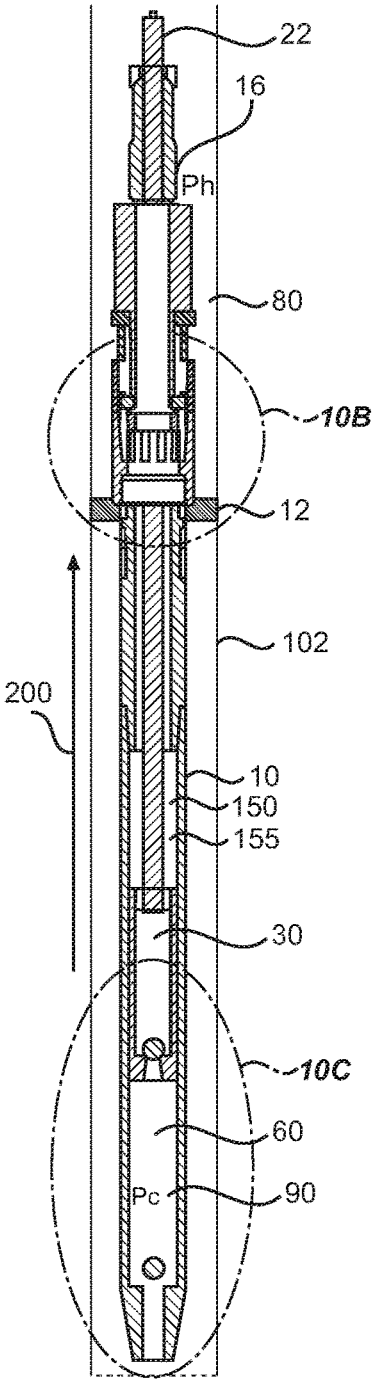
FIG. 10A is a cross-sectional view of the assembled improved superimposed standing valve in the open position and connected to an oil well pump at the bottom and connected to a rod guide at the top all housed within an oil well casing.
Figure 10B:
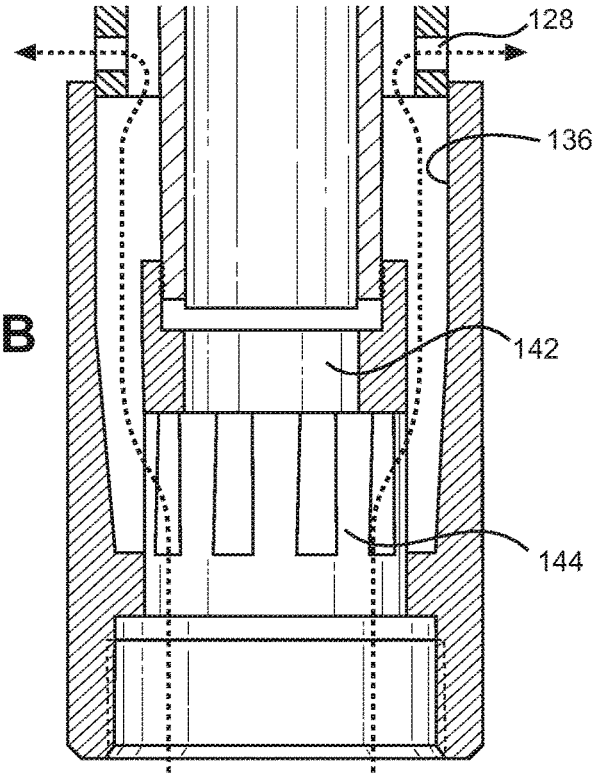
FIG. 10B is a close-up view of the superimposed standing valve shown in 7A and showing that the valve cylindrical sleeve is in the open position thereby allowing the flow of oil and gas through the sidewall ports.
Figure 10C:
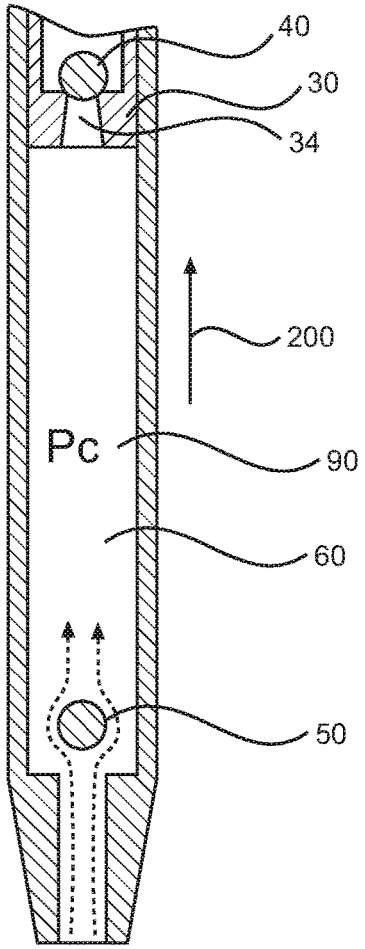
FIG. 10C is a close-up view of the oil well pump show in 7A and showing the standing valve in the open position with the traveling valve in the closed position.

Turing to FIGS. 10A though 10C, the improved superimposed standing valve 100 is shown in use with a conventional rod pump 10 during the upstroke of the polished rod 22. The polished rod 22 passes through the rod guide 16, through the central passage 112 of the top cylinder 110, through the main valve central bore 142 and into the pump cylinder 15 where it is connected to the plunger 30 the rod pump 10.

The inclusion of the improved superimposed standing valve 100 between the rod guide 16 and the pump 10 creates a valve chamber 150 between the central manifold 144 of the main standing valve 130 and the plunger 30 of the pump 10, with a valve chamber volume at a valve pressure Pv 155. As the plunger 30 moves in the up direction 200, the pump chamber 60 volume increases while the valve chamber 150 volume decreases. Similarly, as the plunger 30 moves in the up direction 200, the chamber pressure Pc 90 decreases while the valve pressure Pv 155 increases. Once the valve pressure Pv 155 exceeds the head pressure Ph 80, the valve cylindrical sleeve 120 unseals from the main valve top 138 thereby enabling oil 3 and gas 5 to travel from the central manifold 144, through slanted passageways 134, and out the plurality of openings 132 until the plurality of sidewall ports 128 are exposed to the tubing 102. Once so exposed, oil 3 and gas 5 travel out of the plurality of sidewall ports 128 and into the tubing 102, above the pump 10 and API lock 12.

Also during the upstroke, as the plunger 30 moves in up direction 200, the chamber pressure Pc 90 is less than the formation pressure Pf 70, thereby ensuring that the standing valve 50 remains up (open). The formation pressure Pf 70 then drives oil 3 and gas 5 into the inlet 17 of the rod pump 10 and into the pump chamber 60.

During the upstroke, the moment the valve pressure Pv 155 exceeds the chamber pressure Pc 90 of the pump 10, the traveling valve 40 closes, thereby isolating the standing valve 50 and pump chamber 60 from the head pressure Ph 80.

Figure 11A:
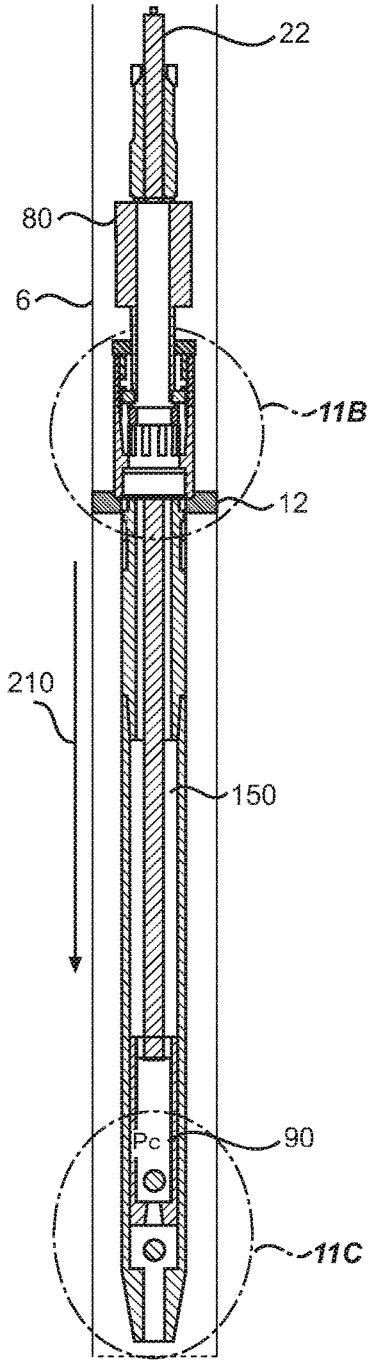
FIG. 11A is a cross-sectional view of the assembled improved superimposed standing valve in the closed position and connected to an oil well pump at the bottom and connected to a rod guide at the top all housed within an oil well casing.
Figure 11B:
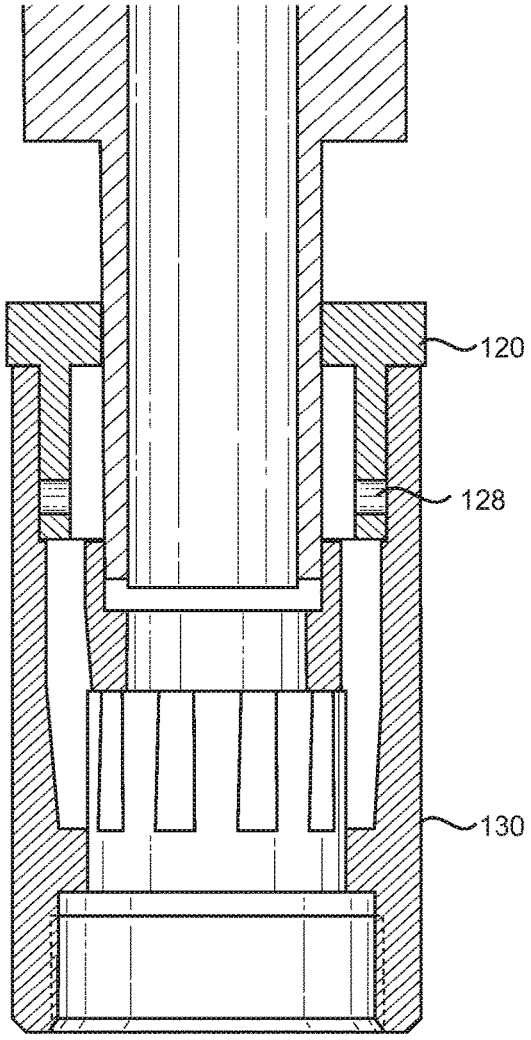
FIG. 11B is a close-up view of the superimposed standing valve shown in 8A and showing that the valve cylindrical sleeve is in the closed position thereby precluding the flow of oil and gas through the sidewall port and isolating the pump from the head pressure created by the column of oil above the valve in the oil well casing.
Figure 11C:
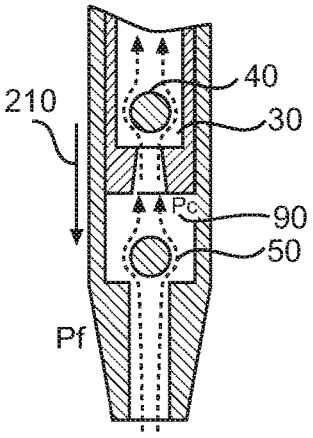
FIG. 11C is a close-up view of the oil well pump show in 8A and showing the standing valve in the open position with the traveling valve in the open position as a result of the isolation from the head pressure in the oil well casing.

Turning next to FIGS. 11A through 11C, the improved superimposed standing valve 100 is shown in use with a conventional rod pump 10 during the downstroke of the polished rod 22 and plunger 30. As the plunger 30 moves in the down direction 210, the volume of the pump chamber 60 decreases while the volume of the valve chamber 150 increases. Similarly, as the plunger 30 moves in the down direction 210, the chamber pressure Pc 90 increases while the valve pressure Pv 155 decreases. Once the head pressure Ph 80 exceeds the valve pressure Pv 155, the valve cylindrical sleeve 120 is forced back down the valve stroke 111 until the valve cylindrical sleeve seats on the main valve top 138 and seals the plurality of openings 132. Once so sealed, the main standing valve 130 and pump 10 are isolated from the head pressure Ph 80.

The isolation of the main standing valve 130 from the head pressure Ph 80 during the downstroke greatly increases the efficiency of the pump 10 on the downstroke. As the plunger 30 continues to move in down direction 210, while isolated from the head pressure Ph 80, the chamber pressure Pc 90 no longer has to overcome the head pressure Ph 80 in order to open the traveling valve 40. Instead, the chamber pressure Pc 90 merely has to overcome the valve pressure Pv 155 in order to open the traveling valve 40, which is a significantly lower pressure than the existing head pressure Ph 80. In many instances, this requisite pressure is lower than the surrounding formation pressure Pf 70. As a result, even on the downstroke, the standing valve 50 remains open. More specifically, since during the downstroke the increasing chamber pressure Pc 90 is only attempting to overcome the decreasing valve pressure Pv 155 without the additional burden of the head pressure Ph 80, the formation pressure Pf 70 will exceed the chamber pressure Pc 90 on the downstroke thereby ensuring that the standing valve 50 remains open.

Therefore, the improved superimposed standing valve 100 enables the standing valve 50 of a conventional rod pump 10 to be open both on the upstroke and the downstroke, thereby increasing the efficiency of the rod pump 10 since fluid enters the pump 10 both on the upstroke and the downstroke. Moreover, the efficiency of the pump 10 is further improved because the pump 10 does not have to overcome the head pressure Ph 80 in order to move oil 3 and gas 5 into the pump 10. These increases in efficiency also decrease the likelihood of gas locking because the pump 10 can now draw oil 3 into the plunger chamber 32 at pressures much lower than the head pressure Ph 80.

An additional benefit of the improved superimposed standing valve 100 is that the valve cylindrical sleeve 120 prohibits oil 3 and gas 5 from settling into the pump 10 during periods of non-use. When the pump 10 is stopped, the head pressure Ph generated by the column of oil 3 and gas 5 above the improved superimposed standing valve 100 causes the valve cylindrical sleeve 120 to quickly seal on the main standing valve 130. Once so sealed, all settling debris in the column of oil 3 and gas 5 have no flow path into the pump 10, thereby increasing the lifespan of the component parts of the pump 10, including the plunger 30, standing valve 50, and traveling valve 40.

The functional benefits of the improved superimposed standing valve are equally present in the alternative embodiment of the valve 300, the only difference being the flow path of oil and gas through the plurality of main valve sidewall ports 328 as opposed to through the plurality of sidewall ports 128 in the cylindrical sliding portion 120.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

While there have been shown what are presently considered to be preferred embodiments of the present invention, it will be apparent to those skilled in the art that various changes and modifications can be made herein without departing from the scope and spirit of the invention. Accordingly, the invention is not to be limited as except by the appended claims.

What is claimed is:

1. An improved superimposed standing valve comprising:

a top cylinder with a top cylinder top and a top cylinder bottom with a central passage through the top cylinder wherein the central passage is sized to slidably receive a polished rod and is open at the top cylinder top and the top cylinder bottom wherein the top cylinder has a top cylinder diameter portion and a reduced top cylinder diameter portion;

a main standing valve with a main valve top and a main valve bottom and formed with a recessed area surface accessible from the main valve top and separated from the main valve top by a cylindrical inner slide wall, a main valve central bore open at the main valve bottom and at the recessed area surface, and at least one opening at the recessed area surface with a passageway connecting the at least one opening to the main valve bore, wherein the top cylinder bottom is connected to the main standing valve at the recessed surface so that the central bore and the main valve central bore are aligned with one another so as to receive the polished rod; and a valve cylindrical sleeve which slides between an open position and a closed position, having a top member with a top aperture slidably disposed on the reduced top cylinder portion of the top cylinder and a cylindrical sliding portion connected to the top member and slidably disposed within the inner slide wall of the main standing valve and has a plurality of side all ports which are sealed by the inner slide wall when the valve cylindrical sleeve is in the closed position and are not sealed by the inner slide wall when the valve cylindrical sleeve is in the open position.

2. The improved superimposed standing valve of claim 1 wherein the at least one opening is a plurality of equally spaced openings encircling the polished rod.

3. The improved superimposed standing valve of claim 2 wherein the plurality of equally spaced openings is each connected to the main valve bore by a slanted passageway.

4. The improved superimposed standing valve of claim 1 wherein the top cylinder top is sized to connect to a rod guide.

5. The improved superimposed standing valve of claim 1 wherein the main valve bottom is sized to connect to a conventional rod pump.

6. The improved superimposed standing valve of claim 5 wherein the main valve bore and the at least one opening are in fluid communication with the conventional rod pump.

7. A method of operating a rod pump comprising the steps of (a) Providing an improved superimposed standing valve comprising:

a top cylinder with a top cylinder top and a top cylinder bottom with a central passage through the top cylinder wherein the central passage is sized to slidably receive a polished rod and is open at the top cylinder top and the top cylinder bottom wherein the top cylinder has a top cylinder diameter portion and a reduced top cylinder diameter portion;

a main standing valve with a main valve top and a main valve bottom and formed with a recessed area surface accessible from the main valve top and separated from the main valve top by a cylindrical inner slide wall, a main valve central bore open at the main valve bottom and at the recessed area surface, and at least one opening at the recessed area surface with a passageway connecting the at least one opening to the main valve bore, wherein the top cylinder bottom is connected to the main standing valve at the recessed surface so that the central bore and the main valve central bore are aligned with one another so as to receive the polished rod; and a valve cylindrical sleeve which slides between an open position and a closed position, having a top member with a top aperture slidably disposed on the reduced top cylinder portion of the top cylinder and a cylindrical sliding portion connected to the top member and slidably disposed within the inner slide wall of the main standing valve and has a plurality of sidewall ports which are sealed by the inner slide wall when the valve cylindrical sleeve is in a closed position and are not sealed by the inner slide wall when the valve cylindrical sleeve is in the open position;

(b) connecting the main valve bottom to the conventional rod pump wherein the conventional rod pump has a plunger within a pump cylinder and having a traveling valve and the conventional rod pump has an inlet with a standing valve and an outlet in fluid communication with the main valve bottom of the improved superimposed standing valve;

(c) passing a first end of the polished rod through the central passage of the top cylinder and through the main valve central bore of the main standing valve and into the pump cylinder and connected to the plunger of the conventional rod pump; and (d) reciprocating the polished rod up and down to actuate the pump and the improved superimposed standing valve.

8. The method of claim 7 wherein the at least one opening is a plurality of equally spaced openings encircling the central bore.

9. The method of claim 8 wherein the plurality of equally spaced openings is each connected to the main valve bore by a slanted passageway.

10. The method of claim 9 wherein the main standing valve has a top cylinder receiver sized to receive the top cylinder bottom.

11. The method of claim 10 wherein the top cylinder bottom is connected to the top cylinder receiver of the main standing valve and wherein the conventional rod pump is in fluid communication with the central manifold, the slanted passageways and the plurality of equally spaced openings.

* * * * *